United States Patent [19]

Clark et al.

[11] 4,223,500

[45] Sep. 23, 1980

[54] INSULATION MOLDED, LOAD BEARING, PREFABRICATED PANELS

[76] Inventors: Howard K. Clark, R.R. 2, Kellogg, Iowa 50135; Archie A. Wilson, 3055 S. Farrell St., Chicago, Ill. 60608

[21] Appl. No.: 904,462

[22] Filed: May 10, 1978

[51] Int. Cl.[2] ..... E04C 1/00

[52] U.S. Cl. ..... 52/309.4; 52/309.7; 52/584; 52/821

[58] Field of Search ..... 52/309.7, 309.9, 309.11, 52/584, 821, 822, 601, 829, 309.4, 309.16

[56] References Cited

U.S. PATENT DOCUMENTS

| | | | |
|---|---|---|---|
| 3,228,158 | 1/1966 | Russell | 52/829 X |
| 3,400,958 | 9/1968 | Haimes et al. | 52/584 X |
| 3,535,844 | 10/1970 | Claros | 52/309.9 X |
| 3,567,260 | 3/1971 | Norris | 52/584 X |
| 3,736,715 | 6/1973 | Krumwiede | 52/309.11 |
| 4,044,511 | 8/1977 | Lingle | 52/309.9 X |
| 4,114,333 | 9/1978 | Jones et al. | 52/309.11 |

*Primary Examiner*—Price C. Faw, Jr.
*Assistant Examiner*—Carl D. Friedman
*Attorney, Agent, or Firm*—Zarley, McKee, Thomte, Voorhees & Sease

[57] ABSTRACT

A prefabricated building panel capable of bearing weight supporting loads, comprised of a pair of spaced apart rectangular metal frame members which are joined along one side by fastening bolts holding them in rigid relationship with respect to each other, and which have on their opposite side a locking means for locking one pair of panel frame members to the fastening bolts of another pair of frame members, and having the interior panel space defined by the frame members filled with an expandable polymeric insulative material which is molded directly to the panel frame members. As a result, load bearing steel stud frame members can be provided with insulation already installed at the factory, thereby eliminating separate insulating steps at the job site.

5 Claims, 6 Drawing Figures

INSULATION MOLDED, LOAD BEARING, PREFABRICATED PANELS

BACKGROUND OF THE INVENTION

Prefabricated building panels used for framing building structures have heretofore been used. Typically such frames are built of standard dimensions and transported to the job site as needed. In recent times, steel framing systems have been used with some degree of success, substituting steel studs for conventional lumber studding. While there are certain advantages to steel studs in that they have light weight and avoid the normal shrinkage which occurs with lumber, certain problems are inherent in the use of steel studding. One of these problems involves the fact that metal, as opposed to wood, is an excellent heat conductive material. This can result in heat losses in the winter time by conduction through the metal studding and correspondingly cooling losses in times such as summer.

Of course, one means of avoiding significant heat gains or losses through the use of heat conductive metallic studs is to insulate within the steel studding framework. Heretofore such insulating has been accomplished in the same manner traditionally used in the industry. That is, after the frame work has been completely erected on the job site, insulating material is then placed in the frame system by hand, or in more recent times, by injecting foam insulation into the interior space between the studs. The disadvantages with such a system are of course, that erecting of the structure and thereafter insulating the structure involves two separate operations, thereby increasing costs and time. Additionally, insulating after the structure is completely erected is not as efficient in that it is virtually impossible to fill all the voids within the studding framework and gaps which remain after insulating decrease the insulating effectiveness.

Accordingly, one object of this invention is to provide prefabricated panels, especially prefabricated metal framework panels which have the insulation directly adhered to the panel frame members by insulating at the time the panels are made. As a result, the need for a separate insulating step at the job site is avoided and correspondingly, the high cost of labor for this step is avoided.

Another object of this invention is to provide a light structural strength prefabricated panel which is insulated at the manufacturing facility and which is capable of bearing large weight supporting loads.

Another object of this invention is to provide a prefabricated building panel which is designed so that a series of panels can be hooked together in side to side relationship to quickly frame a building at the job site, again eliminating labor costs.

Yet another object of this invention is to provide a prefabricated panel, which has the capability of having installed directly in the panel plumbing circuitry, electrical circuitry or the like so that even these operations can be substantially reduced at the job site.

Yet another object of this invention is to provide a prefabricated building panel which has an expanded polymeric insulative material completely filling the interior panel space and molded directly to the panel frame members at the factory so that insulation effectiveness is maximized and the heat conduction tendency of steel studding is minimized.

The manner of accomplishing these and other objects will become apparent from the detailed description of the invention which follows.

SUMMARY OF THE INVENTION

This invention relates to a prefabricated building panel capable of bearing weight supporting loads, with the panel being especially designed for use with steel framing systems and with the panel having premolded directly to the panel frame members at the factory, an expanded polymeric insulative material which completely fills the interior panel space and is molded directly to the panel frame. The panels have a locking cam and bolt for easy locking of one panel member to another for quick job site construction.

DETAILED DESCRIPTION OF THE INVENTION

Figure 1:
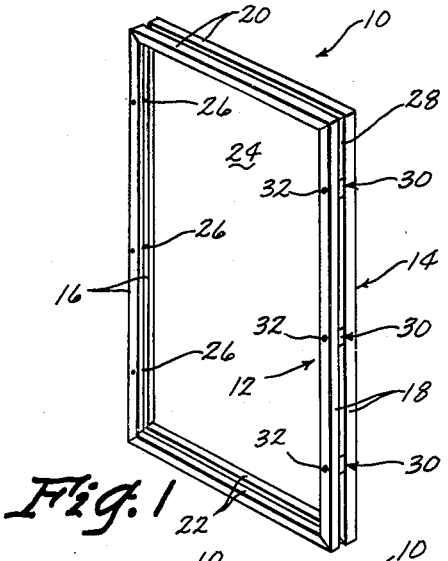
FIG. 1 is a perspective view of one panel of this invention.
Figure 4:
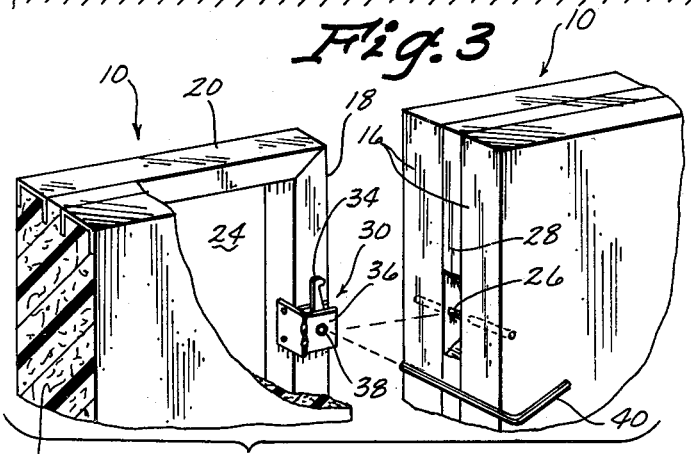
FIG. 4 is an exploded view, with certain parts broken away, showing the cam lock which attaches one panel framework to another.

FIG. 1 shows in perspective view a panel 10 of this invention. It is comprised of a pair of spaced apart rectangular frame members 12 and 14 which are preferably constructed of light steel components and as can be shown more particularly in FIG. 4, are made of C-channel runners.

Since each of frames 12 and 14 are of identical construction, like numerals will be used for like parts. Each frame is comparised of spaced apart side members 16 and 18 joined together by top and bottom frame members 20 and 22 to form a rectangular shape with the interior perimeters of the rectangular shape defining an interior panel space 24. Frame 12 is joined to frame 14 and held in spaced apart relationship with respect thereto by a plurality of fastening bolts 26 extending from side member 16 to side member 18. Fastening bolts 26 serve three purposes. First, they maintain frames 12 and 14 in rigid joined relationship. Secondly, they maintain a spaced apart relationship between frames 12 and 14 in order to prevent direct metal to metal contact to allow heat conduction between the frame members; and, thirdly, they act as locking bolts to lock one panel member to another as will hereinafter be explained.

The gap 28 is important and will be referred to herein as a thermal gap. Gap 28, after the panel is completely constructed, is filled with insulative material, as will hereinafter be explained and therefore prevents substantial heat loss or heat gain from one side of the panel frame to the other. It has been found, that even with use of insulating materials, when the frame members are in fact in direct metal to metal contact, significant conduction occurs between the exterior side and the interior side of the panel which of course is undesirable. The thermal gap 28 prevents this from occurring to any significant extent.

Figure 3:
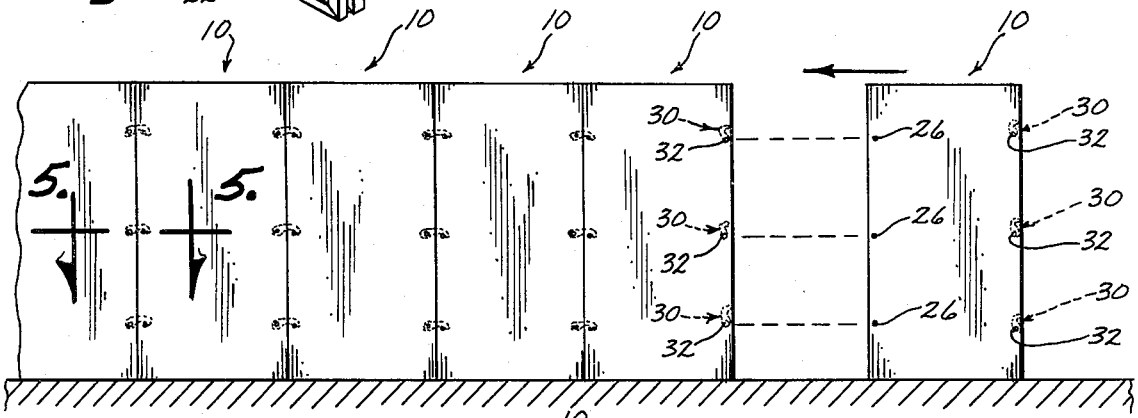
FIG. 3 is an elevated side view, showing how the panels can be attached in side to side relationship to provide framework for a building structure.
Figure 5:
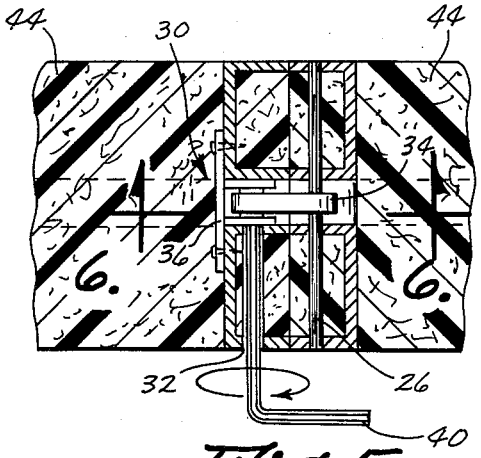
FIG. 5 is a sectional view along line 5—5 of FIG. 3 showing the section through the cam lock with the lock being in its lock engaging position.
Figure 6:
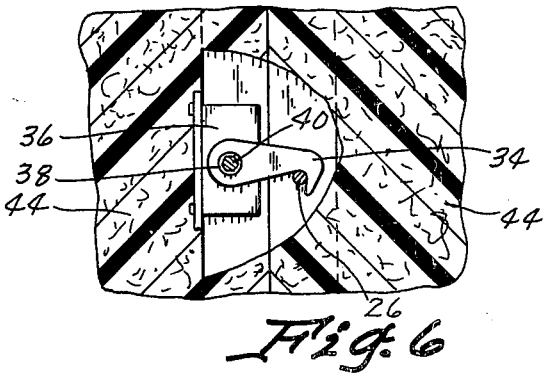
FIG. 6 shows the lock of FIG. 4, with certain parts broken away in its locked position.

At the opposite side from fastening bolts 26 of the panel 10 are a series of cam locks 30. Cam lock 30 is rigidly attached to the side of frame members 12 and 14 in a fashion similar to that for locking bolt 26. Access apertures 32 are provided so that the cam lock can be removed from an unlocked position to a locked position. Cam lock 30 is comprised of a locking lever 34 which is attached to bracket 36 for pivotal movement about a horizontal axis. Locking lever 34 has an octogonal shaped aperture 38 which functions as a key hole. Allen wrench 40 has the same shape as octogonal aperture 38 so that Allen wrench 40 may be inserted through access opening 32 into key hole 38 and twisted to move locking lever 34 from its unlocked position shown in FIG. 4 downwardly to a locked position wherein locking lever 34 moves downwardly over locking bolt 26 to rigidly engage one panel 10 in side by side relationship with a second panel as shown in FIGS. 5 and 6. It therefore can be seen that a wall structure, for example, can quickly be built by locking a series of panels in side by side relationship as depicted in FIG. 3.

After the panel is completely constructed as shown in FIG. 1, it is then ready for molding of an insulative foamed polymeric resin directly to panel frame members.

Figure 2:
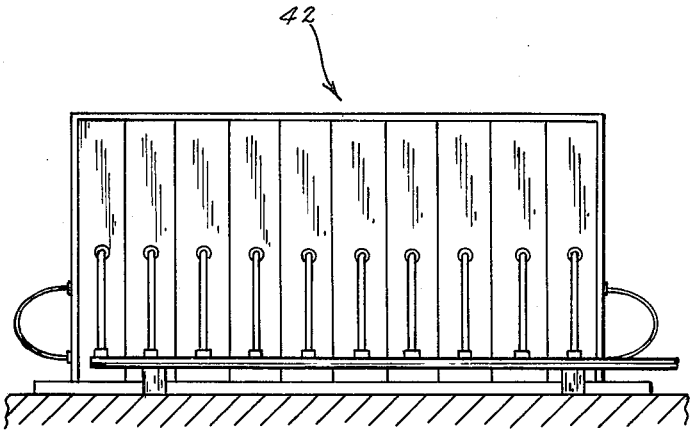
FIG. 2 is an elevated side view of a block mold used to mold the insulative material into the panels.

As is known by those skilled in the art, such molding operations can be accomplished in a block mold 42 depicted schematically in FIG. 2. Such block molds are well known to those skilled in the art, and a detailed description will not be provided herein. For further information with regard to such block molds, see, for example, literature on such molds from manufacturers such as Tri Manufacturing and Sales Company of Lebanon, Ohio. Block mold 42 allows a controlled environment of heat and pressure in order to expand foamable polymeric resin materials such as polystyrene.

It has heretofore been mentioned that an important feature of this invention is that the panels are load bearing panels which have an insulative material completely filling the interior panel space and molded directly to the panel frame members at the factory. When this is accomplished at the factory, as opposed to on job site construction, the insulation is adhered directly to the frame members, insulation shrinkage is avoided, and of course labor costs are minimized. It is believed that insulative material is effectively adhered to the panel frame members 12 and 14 because when insulating is accomplished at the manufacturing facility, the frame members are heated and subjected to steam and pressure along with the expandable foam insulating material whereas if foam is simply injected into the frames at the job site, the frame members have a significant temperature differential, and as a result adherence does not occur, the foam will shrink leaving gaps. This results in a net insulating effectiveness decrease.

A variety of the expandable polymeric insulative materials can be used in this invention. Those which may be used are generally characterized as foamed polymeric resins such as polystyrene, epoxies, polyesters, polyether and polyurethane. However, the preferred member of this group is polystyrene. It is preferred because of its ease of use, avoidance of necessity of using any toxic gases, stability with respect to subsequent shrinkage and decomposition, its ability to adhere to the steel structure frame members, its resistance to flamability, and its general acceptance in the industry as an effective insulative material. The following description of the foaming process employed in this invention will be given with specific regard to polystyrene, although it is to be understood that other resins mentioned herein may be used with satisfactory results, polystyrene, however, being the preferred one.

While the techniques of forming the expanded foam polystyrene are well known, a brief description will be provided herein. Polystyrene beads are injected with a foam expanding agent and run through a pre-expander wherein they are injected with steam and heat which softens the shell of the bead and allows them to expand by virtue of the expanding agent to provide pre-expanded polystyrene. Typical pre-expanders can be obtained from the Tri Manufacturing & Sales Company of Lebanon, Ohio, in units such as their Bu-502 pre-expander can be utilized successfully.

The pre-puffed polystyrene, which has heretofore been mentioned, has been pre-puffed in a pre-expander is then placed in the bottom of block mold 42, as shown in FIG. 2. The block mold is an aluminum housed steam chest which is injected with additional steam heat and pressure.

The pre-assembled panel frame work 10 is placed in block mold 42 and pre-expanded polystyrene has been pre-expanded to provide a density of, for example, from one to two pounds per cubic foot, are dumped into mold 42. The panel framework 10 and polystyrene are thereafter subjected to steam by pressure, for example, of about 70 pounds per square inch gauge, for a period of about 18 seconds, the pressure is thereafter reduced to about 35 pounds pressure, with the material temperatures reaching within the range of about 180° F. to about 200° F.

Thereafter, a cooling time is allowed in order to allow the expanding agent, typically pentane gas, to disperse. The holding time will, of course, vary from material to material but is typically within the range of 2 minutes to 6 minutes.

Thereafter, the locks on the mold are released and the panels removed. The panels are now completely filled with expanded polystyrene 44. The internal cavity of the mold is shaped such that the expanded polystyrene fills the internal panel space 24, with the access apertures 32, cam lock 30 and locking bolt 26 being protected from having polystyrene fused directly thereto to prevent interference with their operation.

After the panel is removed, the polystyrene is adhered to the rectangular frames 12 and 14 and a flat planar surface is provided across the entire panel. After removal from the mold, the panel, if desired, can be covered with an external veneer such as paneling, drywall or the like, the exact exterior veneer depending upon the ultimate end use of the panel.

As heretofore mentioned, if desired, plumbing conduits, electrical conduits or the like can be mounted within the panels prior to molding of the insulative material so that actual job site labor is even further reduced.

The resulting panel is totally constructed before it ever arrives at the job site. It has high structural strength, is a load bearing panel, has the insulation already provided, can be quickly and easily installed at the job site, and results in minimizing on-job site construction costs. It therefore can be seen that the panel accomplishes all of the stated objects of this invention.

What is claimed is:

1. A prefabricated building panel, capable of bearing weight supporting loads, and having insulation premolded into the panel, comprising:

at least a pair of spaced apart metal rectangular frame members connected to each other by spacers which prevent substantial metal to metal contact between said frame members, the interior perimeters of said frame members defining an unobstructed open and freely accessible interior panel space, said frame members being joined along one side by fastening bolts, extending from one panel member to the other, each pair of frames having on its side opposite said fastening bolts, a locking means for locking one pair of panel frame members to the fastening bolts of another pair of panel frame members, and an expanded polymeric insulative material completely filling said interior panel space to define generally flat, planar, interior and exterior surfaces of said prefabricated panel which are exposed through said rectangular opening defined by said frame members and heat molded directly to said panel frame members, while said frame members are being subjected to foam expansion conditions.

2. The panel of claim 1 wherein said locking means is a cam lock mounted between said panels, and one of said panel members has a lock access opening to provide access to said cam lock.

3. The panel of claim 1 wherein said rectangular frame members are comprised of steel studding channel material.

4. The panel of claim 1 wherein said expanded polymeric, insulative material is a foamed polymeric, resin selected from the group consisting of polystyrene epoxies, polyesters, polyether and polyurethane.

5. The panel of claim 4 wherein said foamed polymeric resin is foamed polystyrene beads.

* * * * *